United States Patent [19]

Hoffman et al.

[11] Patent Number: 4,716,956

[45] Date of Patent: Jan. 5, 1988

[54] ROLL CASTER FEED TIP AND METHOD

[75] Inventors: William H. Hoffman, Palmyra; Thomas W. Ebright, Lebanon, both of Pa.

[73] Assignee: Aluminum Company of America, Pittsburgh, Pa.

[21] Appl. No.: 937,564

[22] Filed: Dec. 3, 1986

[51] Int. Cl.[4] ..... B22D 11/06

[52] U.S. Cl. ..... 164/480; 164/428; 164/437; 164/488

[58] Field of Search ..... 164/427, 428, 434, 436, 164/437, 440, 479, 480, 488, 490, 491; 222/590, 591

[56] References Cited

U.S. PATENT DOCUMENTS

| | | | |
|---|---|---|---|
| 2,790,216 | 4/1957 | Hunter | 22/57.5 |
| 4,054,173 | 10/1977 | Hickam | 164/428 |
| 4,134,441 | 1/1979 | Ohmori et al. | 164/4 |
| 4,153,101 | 5/1979 | Chateau et al. | 164/428 |
| 4,232,804 | 11/1980 | Lewis et al. | 222/591 |
| 4,270,593 | 6/1981 | Bachner | 164/82 |
| 4,303,181 | 12/1981 | Lewis et al. | 222/591 |

*Primary Examiner*—Nicholas P. Godici

*Assistant Examiner*—Richard K. Seidel

*Attorney, Agent, or Firm*—Gary P. Topolosky

[57] ABSTRACT

A roll caster feed tip comprising a top member, a bottom member, a pair of fixed side members positioned between the top and bottom members to define a molten metal passageway having at least one inlet and an outlet adjacent the roll caster, said outlet having an adjustable width, and means between the side members for adjusting the width of the outlet during casting. The adjustment means preferably comprises at least one spacer adapted to slidably extend through the inlet and to the outlet of the passageway, said spacer extending adjacent one side member. More preferably, the adjustment means comprises a plurality of spacers adapted to slidably extend through the inlet and to the outlet of the passageway, said spacers extending either adjacent the side members and each other or through channels defined by a plurality of guides extending between the top and bottom members intermediate the side members. A method for adjusting the outlet width of the above roll caster feed tip comprises slidably extending at least one spacer through the inlet of the feed tip, to the outlet and adjacent one side member.

27 Claims, 5 Drawing Figures

ROLL CASTER FEED TIP AND METHOD

BACKGROUND OF THE INVENTION

1. Field of the Invention

This invention relates to roll casting of a molten metal. More particularly, the invention relates to an improved roll caster feed tip and method.

2. Description of the Prior Art

The casting of a molten metal by continuous rolling is well known to those skilled in the art. With roll casters such as that disclosed in U.S. Pat. Nos. 2,790,216 and 4,054,173, molten metal such as aluminum, tin or copper is efficiently rolled into plate, strip or sheet product. The typical roll caster includes a pair of water-cooled rolls that rotate in opposite directions and have a slight gap or space therebetween. When molten metal is fed from a feed tip or nozzle into the roll gap, it rapidly solidifies between or near the rolls to form sheet product. The width of said sheet product is ultimately limited by the dimensions of the roll gap. Casting widths are further controlled, however, by the width of the feed tip outlet. For example, a feed tip having an outlet width of 1 meter (39 inches) casts only sheet product of about the same width, even when positioned adjacent wider roll gaps.

In many instances, it is desirable to produce sheet product of various widths from the same casting of molten metal or metal alloy. Until this invention, however, it was not possible to provide a feed tip having an adjustable outlet width. Conventional roll caster feed tips are made from a plurality of segments joined together and sealed at both ends to produce a particular width of sheet product. In U.S. Pat. Nos. 4,232,804 and 4,303,181, for example, each feed tip segment is about 15 cm (5.9 inches) wide. A plurality of said segments are bolted together to produce sheet product having a particular width between 1.5–2.0 meters (59–79 inches). After a first width of sheet product has been cast, presently known art requires stopping the flow of molten metal to the caster, substituting one feed tip for another and restarting the casting operation. Such casting interruptions are costly in terms of the production time lost and man-hours spent assembling and installing feed tips having various outlet widths. Repeated interruptions also increase the risk of damage to roll casting equipment from undetected deposits of frozen metal.

With respect to the continuous mold casting of metal strands, it is further known to vary the cross-sectional area of the strands by changing the angle of sidewall inclination. Exemplary of such mold variations are those disclosed in U.S. Pat. Nos. 4,134,441 and 4,270,593. There is no teaching or suggestion in either reference to similarly modify a roll caster feed tip. Should the modification be attempted, however, molten metal will tend to leak from movable feed tip sides.

SUMMARY OF THE INVENTION

It is a principal object of this invention to provide an improved feed tip for casting various widths of metal sheet product.

It is a further object of the invention to provide a roll caster feed tip having means for adjusting the outlet width during casting.

It is still a further object of the invention to provide a roll caster feed tip for casting various widths of sheet product without having to stop and restart the casting operation between width changes.

It is still a further object of the invention to provide a method for adjusting the outlet width of a feed tip during casting of a molten metal.

It is still a further object of the invention to overcome the problems and disadvantages of the feed tip art mentioned above.

In accordance with the foregoing objects of the invention, there is provided a roll caster feed tip comprising a top member, a bottom member, a pair of fixed side members positioned between the top and bottom members to define a molten metal passageway having at least one inlet and an outlet adjacent the roll caster, said outlet having an adjustable width, and means for adjusting the width of the outlet during casting. The adjustment means preferably comprises at least one spacer adapted to slidably extend through the inlet and to the outlet of the passageway, said spacer extending adjacent one side member. More preferably, the adjustment means comprises a plurality of spacers adapted to slidably extend through the inlet and to the outlet of the passageway, said spacers extending either adjacent the side members and each other or through channels defined by a plurality of guides extending between the top and bottom members intermediate the side members.

There is further provided a method for adjusting the outlet width of a roll caster feed tip during casting of a molten metal. The method comprises slidably extending at least one spacer through the inlet of the feed tip, to the outlet and adjacent one side member.

BRIEF DESCRIPTION OF THE DRAWINGS

Further features, other objects and advantages of the invention will become clear from the following detailed discussion of the preferred embodiments made with reference to the drawings in which.

DETAILED DESCRIPTION OF THE PREFERRED EMBODIMENTS

In the description of the preferred embodiments which follows, repeated reference is made to the roll casting of sheet product wherein the molten metal is an aluminum alloy. It is to be understood, however, that the invention may also be used to cast other metals and metal alloys such as tin, lead, copper, zinc, and the like.

Figure 1:
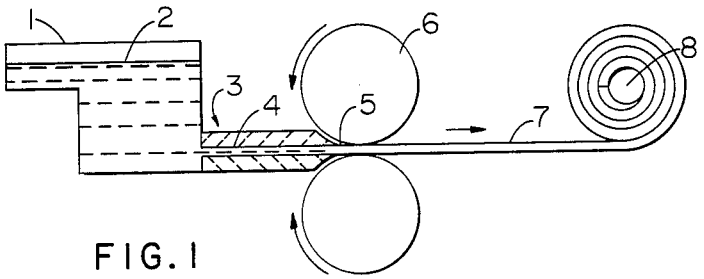
FIG. 1 is a side schematic representation of a roll caster and feed tip according to the invention.

Referring now to FIG. 1, there is schematically shown a roll caster and feed tip according to the invention. Particularly, the roll caster includes a reservoir 1 containing molten metal 2, such as aluminum alloy. Reservoir 1 communicates directly with a feed tip, generally 3, which delivers molten metal through passageway 4 and into the gap 5 between watercooled rolls 6. Alternatively, the reservoir may connect to a tube and float mechanism (not shown) for maintaining a constant level of molten metal in a holding tank (also not shown) adjacent the feed tip. As rolls 6 rotate in the opposite directions indicated by the arrows in FIG. 1, the molten metal fed into gap 5 solidifies to form sheet product 7. Sheet product 7 may then pass through intermediate deflecting rolls or treatment tanks (not shown) before being wound on spool 8. For convenience of illustration, the roll caster and feed tip of FIG. 1 are shown in a horizontal plane with rolls 6 vertically propagated one above the other. It is to be understood, however, that the invention may also be used with other casting configurations including those where the rolls are horizontally propagated.

Several embodiments of feed tips are described herein for delivering molten metal into gap 5 and between rolls 6 according to the invention. A first and second embodiment of feed tip is shown in adjacent halves of FIG. 2 separated by a dotted line. The opposing halves of each embodiment either mirror the portion illustrated or include no width adjustment means at all.

Figure 2:
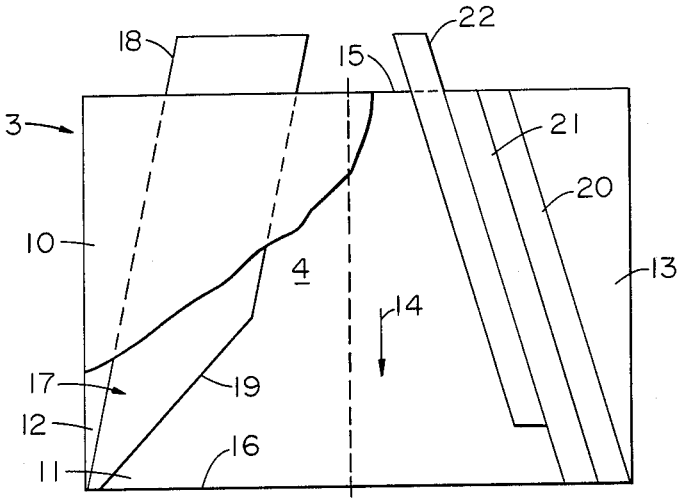
FIG. 2 is a plan view, partially in section, of a first and second embodiment of the feed tip in FIG. 1.

A first embodiment of feed tip 3, in the left of FIG. 2, comprises a top member 10 (partially removed), a bottom member 11 and a fixed side member 12. Feed tip 3 further comprises a second side member 13 appearing in the right half of FIG. 2. The pair of fixed side members 12, 13 are positioned between top member 10 and bottom member 11 to define a passageway 4 through which molten metal flows in the direction of arrow 14. Passageway 4 has at least one inlet 15 and an outlet 16 adjacent the roll caster, said outlet having an adjustable width. Feed tip 3 further comprises means for adjusting the width of outlet 16 during casting. More particularly, the adjustment means of the first embodiment comprises at least one spacer 17 adapted to slidably extend through inlet 15 and to outlet 16 of the passageway. Preferably, spacer 17 is made from a refractory material and extends adjacent one side member of the feed tip, herein side member 12. As shown, spacer 17 has an overall length greater than feed tip 3. Hence, a portion 18 of this spacer extends outwardly beyond inlet 15. Spacer 17 also includes a beveled or sharply angled front edge 19 extending to outlet 16. When spacer 17 is inserted between parallel top and bottom members and made of material that disintegrates with roll contact, spacer 17 is repeatedly advanced through the feed tip to force more of front edge 19 through outlet 16, thereby reducing the width of same.

According to a second embodiment of the invention, feed tip 3 includes a top member 10, bottom member 11, a pair of fixed side members 12, 13, and an alternative outlet width adjustment means. More particularly, the adjustment means of the right half of FIG. 2 comprises a plurality of spacers 20, 21, 22 adapted to slidably extend through inlet 15 and to outlet 16 of passageway 4. Preferably, these spacers are made of a refractory material and extend directly adjacent the side members and each other. As illustrated, spacer 20 extends adjacent side member 13 and spacer 21 extends adjacent spacer 20. Spacer 22, which extends partially along spacer 21 and outwardly beyond inlet 15, is adapted to be further advanced in the direction of arrow 14 to reduce the width of outlet 16.

In the second embodiment, spacers 20, 21, 22 are substantially rectangularly-shaped and have installed lengths equal to feed tip 3. Hence, when the rear spacer edges are flush with the inlet of feed tip 3, the spacers are fully extended to outlet 16. Alternatively, the multiple spacers of this embodiment may be varied in size and shape or extend outwardly beyond inlet 15 when completely extended through the feed tip. Preferably, the spacers of the second embodiment extend adjacent both side members in approximately equal proportions.

Figure 3:
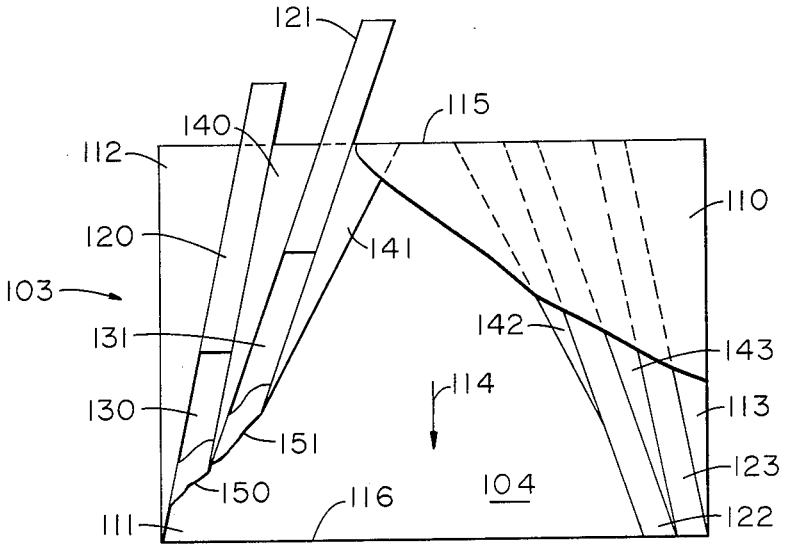
FIG. 3 is a plan view, partially in section, of a third embodiment of the feed tip according to the invention.
Figure 4:
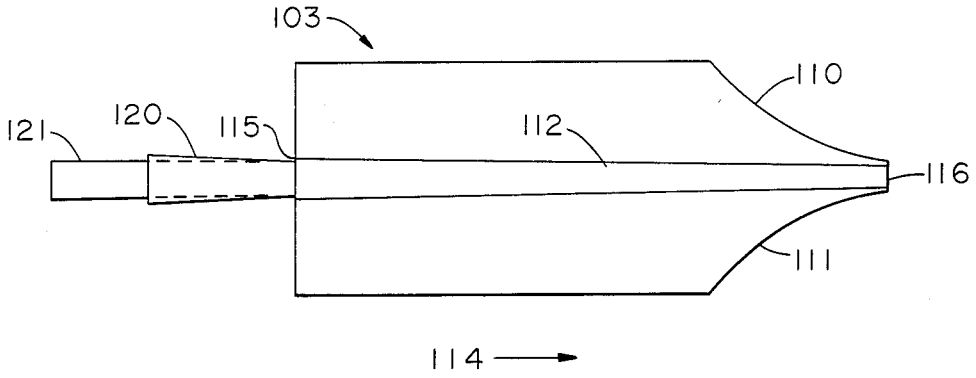
FIG. 4 is a side elevational view of the feed tip of FIG. 3.
Figure 5:
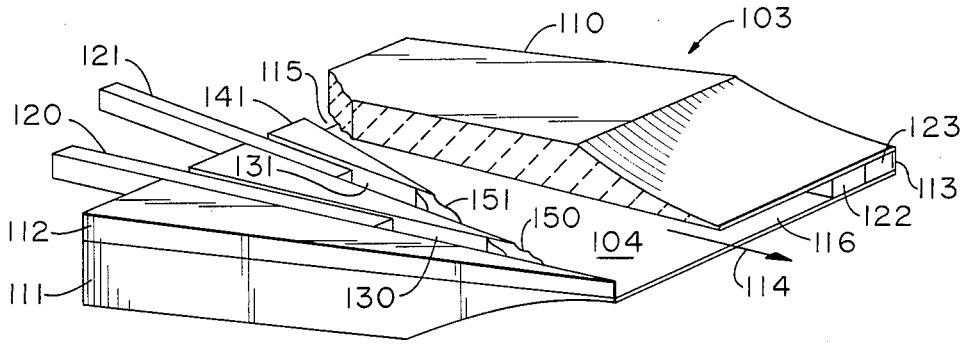
FIG. 5 is a perspective view, partially in section, of the feed tip of FIG. 3.

Referring now to FIGS. 3–5, there is shown a third embodiment of the invention. Particularly, roll caster feed tip 103 comprises a top member 110 and a bottom member 111, each member having an outer surface tapered to the roll caster. Feed tip 103 further comprises a pair of fixed side members 112, 113 positioned between the top and bottom members to define a passageway 104 through which molten metal flows in the direction of arrow 114. Passageway 104 has at least one inlet 115 and an outlet 116 adjacent the roll caster, said outlet having an adjustable width as further described herein.

The third embodiment further comprises means for adjusting the width of outlet 116 during casting. The adjustment means of feed tip 103 comprises a plurality of spacers 120, 121, 122, 123 adapted to slidably extend through inlet 115 and to outlet 116 of passageway 104. More particularly, these spacers extend through channels 130, 131 defined by a plurality of guides 140, 141, 142, 143 extending from inlet 115 and between the top and bottom members intermediate side members 112, 113. Spacers 120, 121, 122, 123 are partially extended through the channels during assembly of feed tip 103. Alternatively, these spacers may be inserted into and through channels 130, 131 when needed. In FIGS. 3 and 5, there are additional channels extending between guides 142, 143 and side member 113. Said channels are not visible, however, due to the full extension of spacers 122, 123. To prevent molten metal from flowing into the guide-defined channels when the spacers are not extended therethrough, the adjustment means further comprises removable means 150, 151 for damming the channel ends. The damming means consists of any known material which is molded, compressed, cast, or otherwise packed between the ends of channels 130, 131 in passageway 104. Preferably, the damming means is not wetted by the molten metal.

In the operation of the third embodiment of this invention, a first width of sheet product is cast from feed tip 103. Preferably, the first width is the widest sheet product desired. After the first width has been completely cast, it becomes necessary to extend a first spacer or spacer pair to outlet 116. Therefore, pressure is exerted from the rear edges of spacers 120, 123 to force damming means 150 into the flow of molten metal through passageway 104. Spacers 120, 123 are then extended to outlet 116 to reduce the width of sheet product during casting. After a second width has been cast, the width of outlet 116 may be further adjusted by forcing spacers 121, 122 through damming means 151 and to the outlet 116.

In the preferred embodiments of this invention, guides 140, 141, 142, 143 are fixed and substantially wedge-shaped. These guides are also permanently affixed to the top and/or bottom members by any known means during assembly of feed tip 103. The spacers which extend through these guides are made from a refractory material not wetted by molten aluminum alloy. Most preferably, the guides and spacers are adapted to extend through a passageway 104 which diverges from the inlet between the side members and converges between the top and bottom members to the outlet.

Each of the foregoing roll caster feed tips provides means for adjusting outlet width during casting. More particularly, outlet widths are reduced by extending at least one spacer from the inlet to the outlet while molten metal is continuously fed therethrough. There is no leakage of molten metal from the feed tips during width adjustment nor is there any damage caused to the roll casting equipment. Although the invention permits outlet width adjustment by spacer extension from only one side member, it is most preferred that outlet widths be proportionately reduced from both side members at the same time. When outlet widths are adjusted in this manner, the thick metal crown which naturally forms is maintained closer to the sheet product center.

The invention also discloses a method for adjusting the outlet width of a roll caster feed tip during casting of a molten metal, said feed tip including a top member, a bottom member, and a pair of fixed side members positioned between the top and bottom members to define a molten metal passageway having at least one inlet. The method comprises slidably extending at least one spacer through the inlet of the feed tip, to the outlet and adjacent one side member.

There is further disclosed a method for adjusting the outlet width of a roll caster feed tip comprising a top member, a bottom member, a pair of fixed side members positioned between the top and bottom members, a plurality of spacers adapted to slidably extend through channels defined by a plurality of fixed guides extending between the top and bottom members intermediate the side members, and removable means for damming the channel ends when the spacers are not extended therethrough. This method comprises slidably extending the spacers through the channels to the damming means, forcing the damming means outwardly, and slidably extending the spacers to the outlet.

The following examples are intended by way of illustration and not intended to limit the scope of this invention.

EXAMPLE 1

A feed tip according to the third embodiment (FIGS. 3–5) was assembled for roll casting various widths of sheet product from 3003 aluminum alloy (Aluminum Association designation). The top member, bottom member, side members, and wedge-shaped guides of this feed tip were made from an alumino-silicate fiberboard sold by Pyrotek Incorporated of Carlisle, Pa. under the trade name "R-21 TH". The foregoing members define a passageway which diverges from an inlet 20 mm (0.8 inch) high × 96 cm (38 inches) wide between the side members and coverges between the top and bottom members to an initial outlet 5 mm (0.2 inch) high × 126 cm (49.5 inches) wide. The spacers extending between channels defined by the above guides and side members were about 20 mm (0.79 inch) wide, made from a refractory material having a density of about 640 kg/m$^3$ (40 lbs/ft$^3$), a melting point of 1760° C. (3200° F.) and consisted essentially of 44.4% alumina and 55.0% silica. The damming means packed into the channel ends during assembly consisted of a calcium carbonate-based powder sold by the Mississippi Lime Company of St. Genevieve, Mo. as "Whiting". After the aforementioned feed tip was assembled, it was positioned adjacent a horizontally propagated roll caster to produce sheet product having a width of about 126 cm (49.5 inches). An outer pair of spacers were then forced through the first damming means and extended to the feed tip outlet to continuously cast sheet product having a width of about 121 cm (47.5 inches). A second pair of spacers were then forced through damming means and extended to the feed tip outlet to produce sheet product about 116 cm (45.5 inches) wide.

EXAMPLE 2

The roll caster feed tip of Example 1 was proportionately increased in size to produce 3003 aluminum alloy sheet product having an initial width of 155 cm (61 inches). An outer pair of spacers were then extended adjacent each side member while molten aluminum was continuously fed therethrough to produce sheet product having a width of about 143 cm (56.5 inches). A second pair of spacers were then extended through the outlet to produce sheet product about 135 cm (53 inches) wide.

Having described the presently preferred embodiments of the invention, it is to be understood that the invention may be otherwise embodied within the scope of the appended claims.

What is claimed is:

1. A roll caster feed tip comprising:

a top member;

a bottom member;

a pair of fixed side members positioned between the top and bottom members to define a molten metal passageway having at least one inlet and an outlet adjacent the roll caster, said outlet having an adjustable width; and means between the side members for adjusting the width of the outlet during casting.

2. The feed tip of claim 1 wherein the passageway diverges from the inlet between the side members.

3. The feed tip of claim 2 wherein the passageway converges between the top and bottom members to the outlet.

4. The feed tip of claim 1 wherein the adjustment means comprises:

at least one spacer adapted to slidably extend through the inlet and to the outlet of the passageway.

5. The feed tip of claim 4 wherein the spacer extends adjacent one side member.

6. The feed tip of claim 4 wherein the spacer is made from a refractory material.

7. The feed tip of claim 1 wherein the adjustment means comprises:

a plurality of spacers adapted to slidably extend through the inlet and to the outlet of the passageway.

8. The feed tip of claim 7 wherein the spacers extend adjacent the side members and each other.

9. The feed tip of claim 7 wherein the spacers extend through channels defined by:

a plurality of guides extending between the top and bottom members intermediate the side members.

10. The feed tip of claim 9 wherein the guides are fixed and substantially wedge-shaped.

11. The feed tip of claim 9 wherein the adjustment means further comprises:

removable means for damming the channel ends when the spacers are not extended therethrough.

12. The feed tip of claim 1 wherein the molten metal is an aluminum alloy.

13. A roll caster feed tip comprising:

a top member;

a bottom member;

a pair of fixed side members positioned between the top and bottom members to define a molten metal passageway having at least one inlet and an outlet adjacent the roll caster, said outlet having an adjustable width; and at least one spacer adapted to slidably extend between the side members through the inlet and to the outlet for adjusting the width of the outlet during casting.

14. The feed tip of claim 13 wherein the passageway diverges from the inlet between the side members and converges between the top and bottom members to the outlet.

15. The feed tip of claim 13 wherein the spacer extends adjacent one side member.

16. The feed tip of claim 13 wherein the spacer is made from a refractory material.

17. The feed tip of claim 13 wherein the molten metal is an aluminum alloy.

18. A roll caster feed tip comprising:

a top member;

a bottom member;

a pair of fixed side members positioned between the top and bottom members to define a molten metal passageway having at least one inlet and an outlet adjacent the roll caster, said outlet having an adjustable width; and a plurality of spacers adapted to slidably extend between the side members through the inlet and to the outlet for adjusting the width of the outlet during casting.

19. The feed tip of claim 18 wherein the spacers extend adjacent the side members and each other.

20. The feed tip of claim 18 wherein the spacers extend through channels defined by a plurality of guides extending between the top and bottom members intermediate the side members.

21. The feed tip of claim 20 wherein the guides are fixed and substantially wedge-shaped.

22. The feed tip of claim 20 further comprising:

removable means for damming the channel ends when the spacers are not extended therethrough.

23. The feed tip of claim 18 wherein the molten metal is an aluminum alloy.

24. A method for adjusting the outlet width of a roll caster feed tip during casting of a molten metal, said feed tip including a top member, a bottom member, and a pair of fixed side members positioned between the top and bottom members to define a molten metal passageway having at least one inlet, said method comprising:

slidably extending at least one spacer through the inlet of the feed tip, to the outlet and adjacent one side member.

25. The method of claim 24 wherein the spacer is made from a refractory material.

26. The method of claim 24 wherein the molten metal is an aluminum alloy.

27. A method for adjusting the outlet width of a roll caster feed tip comprising a top member, a bottom member, a pair of fixed side members positioned between the top and bottom members, a plurality of spacers adapted to slidably extend through channels defined by a plurality of fixed guides extending between the top and bottom members intermediate the side members, and removable means for damming the channel ends when the spacers are not extended therethrough, said method comprising:

slidably extending the spacers through the channels to the damming means;

forcing the damming means outwardly; and slidably extending the spacers to the outlet.

* * * * *